US006540032B1

(12) United States Patent
Krueger

(10) Patent No.: US 6,540,032 B1
(45) Date of Patent: Apr. 1, 2003

(54) APPARATUS FOR TRANSFERRING ELECTRICAL ENERGY BETWEEN ROTATING AND NON-ROTATING MEMBERS OF DOWNHOLE TOOLS

(75) Inventor: Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/687,680

(22) Filed: Oct. 13, 2000

Related U.S. Application Data

(60) Provisional application No. 60/159,234, filed on Oct. 13, 1999.

(51) Int. Cl.[7] ..... E21B 4/00; E21B 47/00

(52) U.S. Cl. ..... 175/40; 175/320

(58) Field of Search ..... 175/40, 320, 104, 175/107; 166/65.1

(56) References Cited

U.S. PATENT DOCUMENTS

| | | | | |
|---|---|---|---|---|
| 4,630,243 A | * | 12/1986 | MacLeod | 175/42 |
| 5,268,683 A | * | 12/1993 | Stolarczyk | 175/40 |
| 5,720,355 A | | 2/1998 | Lamine et al. | 175/27 |
| 5,836,406 A | * | 11/1998 | Schuh | 175/107 |
| 5,931,239 A | | 8/1999 | Schuh | 175/61 |
| 5,957,221 A | | 9/1999 | Hay et al. | 175/44 |
| 6,092,610 A | * | 7/2000 | Kosmala et al. | 175/61 |
| 6,148,933 A | * | 11/2000 | Hay et al. | 175/325.2 |
| 6,247,542 B1 | * | 6/2001 | Kruspe et al. | 166/66 |

FOREIGN PATENT DOCUMENTS

WO WO 98/34003 8/1998

* cited by examiner

*Primary Examiner*—Hoang Dang
(74) *Attorney, Agent, or Firm*—Madan, Mossman & Sriram, P.C.

(57) ABSTRACT

In general, the present invention provides a contactless apparatus for power and data transfer over a gap between rotating and non-rotating members of downhole oilfield tools. The gap usually contains a fluid, such as drilling fluid, or oil for operating hydraulic devices in the downhole tool. The downhole tool in one embodiment is a drilling assembly wherein a drive shaft is rotated by a downhole motor to rotate the drill bit attached to the bottom end of the drive shaft. A substantially non-rotating sleeve around the drive shaft includes at least one electrically-operated device. An electric power and data transfer device transfers electric power and data between the rotating and non-rotating members. An electronic control circuit associated with the rotating member controls the transfer of power and data from the rotating member to the non-rotating member. An electrical control circuit carried by the non-rotating member controls the transfer of data from sensors and devices carried by the non-rotating member to the rotating member.

23 Claims, 6 Drawing Sheets

APPARATUS FOR TRANSFERRING ELECTRICAL ENERGY BETWEEN ROTATING AND NON-ROTATING MEMBERS OF DOWNHOLE TOOLS

CROSS-REFERENCE TO RELATED APPLICATIONS

This Application is related to U.S. Provisional Application Ser. No. 60/159,234 filed in the United States Patent and Trademark Office on Oct. 13, 1999 priority from which is claimed and the specification of which is incorporated herein by reference.

BACKGROUND OF THE INVENTION

1. Field of the Invention

This invention relates generally to oilfield downhole tools and more particularly to drilling assemblies utilized for drilling wellbores in which electrical power and data are transferred between rotating and a non-rotating sections of the drilling assembly.

2. Description of the Related Art

To obtain hydrocarbons such as oil and gas, boreholes or wellbores are drilled by rotating a drill bit attached to the bottom of a drilling assembly (also referred to herein as a "Bottom Hole Assembly" or "BHA"). The drilling assembly is attached to the bottom of a tubing, which is usually either a jointed rigid pipe or a relatively flexible spoolable tubing commonly referred to in the art as the "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of the current drilling activity involves drilling of deviated and horizontal wellbores to more fully exploit the hydrocarbon reservoirs. Such boreholes can have relatively complex well profiles. To drill such complex boreholes, drilling assemblies are utilized which include a plurality of independently operable force application members to apply force on the wellbore wall during drilling of the wellbore to maintain the drill bit along a prescribed path and to alter the drilling direction. Such force application members may be disposed on the outer periphery of the drilling assembly body or on a non-rotating sleeve disposed around the rotating drive shaft. These force application members are moved radially to apply force on the wellbore in order to guide the drill bit and/or to change the drilling direction outward by electrical devices or electro-hydraulic devices. In such drilling assemblies, there exists a gap between the rotating and the non-rotating sections. To reduce the overall size of the drilling assembly and to provide more power to the ribs, it is desirable to locate the devices (such as motor and pump) required to operate the force application members in the non-rotating section. It is also desirable to locate electronic circuits and certain sensors in the non-rotating section. Thus, power must be transferred between the rotating section and the non-rotating section to operate electrically-operated devices and the sensors in the non-rotating section. Data also must be transferred between the rotating and the non-rotating sections of such a drilling assembly. Sealed slip rings are often utilized for transferring power and data. The seals often break causing tool failures downhole.

In drilling assemblies which do not include a non-rotating sleeve as described above, it is desirable to transfer power and data between the rotating drill shaft of a drilling motor and the stationary housing surrounding the drill shaft. The power transferred to the rotating shaft may be utilized to operate sensors in the rotating shaft and/or drill bit. Power and data transfer between rotating and non-rotating section having a gap therebetween can also be useful in other downhole tool configurations.

The present invention provides contactless inductive coupling to transfer power and data between rotating and non-rotating sections of downhole oilfield tools, including the drilling assemblies containing rotating and non-rotating members.

SUMMARY OF THE INVENTION

In general, the present invention provides apparatus and method for power and data transfer over a gap between rotating and non-rotating members of downhole oilfield tools. The gap may contain a non-conductive fluid, such as drilling fluid or oil for operating hydraulic devices in the downhole tool. The downhole tool, in one embodiment, is a drilling assembly wherein a drive shaft is rotated by a downhole motor to rotate the drill bit attached to the bottom end of the drive shaft. A substantially non-rotating sleeve around the drive shaft includes a plurality of independently-operated force application members, wherein each such member is adapted to be moved radially between a retracted position and an extended position. The force application members are operated to exert the force required to maintain and/or alter the drilling direction. In a preferred system, a common or separate electrically-operated hydraulic units provide energy (power) to the force application members. An inductive coupling transfers device transfers electrical power and data between the rotating and non-rotating members. An electronic control circuit or unit associated with the rotating member controls the transfer of power and data between the rotating member and the non-rotating member. An electrical control circuit or unit carried by the non-rotating member controls power to the devices in the non-rotating member and also controls the transfer of data from sensors and devices carried by the non-rotating member to the rotating member.

In an alternative embodiment of the invention, an inductive coupling device transfers power from the substantially non-rotating housing of a drilling motor to the rotating drill shaft. The electrical power transferred to the rotating drill shaft is utilized to operate one or more sensors in the drill bit and/or the bearing assembly. A control circuit near the drill bit controls transfer of data from the sensors in the rotating member to the non-rotating housing.

The inductive coupling may also be provided in a separate module above the mud motor to transfer power from a non-rotating section to the rotating member of the mud motor and the drill bit. The power transferred may be utilized to operate devices and sensors in the rotating sections of the drilling assembly, such as the drill shaft and the drill bit. Data is transferred from devices and sensors in the rotating section to the non-rotating section via the same or a separate inductive coupling. Data in the various embodiments is transferred by frequency modulation, amplitude modulation or by discrete signals.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
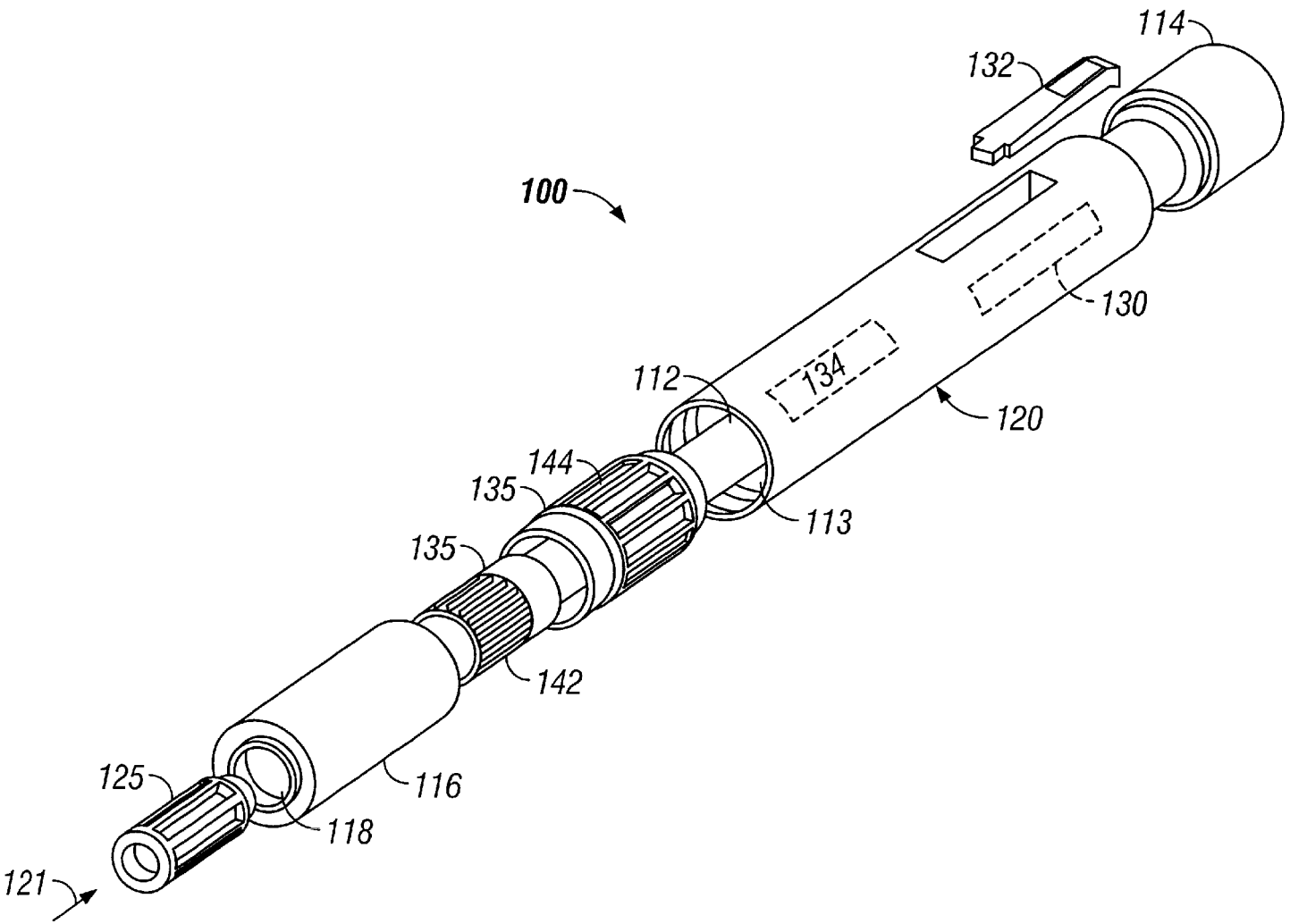
FIG. 1 is an isometric view of a section of a drilling assembly showing the relative position of a rotating drive shaft (the "rotating member") and a non-rotating sleeve (the "non-rotating member") and an electrical power and data transfer device for transferring power and data between the rotating and non-rotating members across a gap according to one embodiment of the present invention.

FIG. 1 is an isometric view of a section or portion 100 of a drilling assembly showing the relative position of a rotating hollow drive shaft 112 (rotating member) and a non-rotating sleeve 120 (non-rotating member) with a gap 113 therebetween and an electric power and data transfer device 135 for transferring power and data between the rotating drive shaft and the non-rotating sleeve over the gap 113, according to one embodiment of the present invention. The gap 113 may or may not be filled with a fluid. The fluid, if used, may be conductive or non-conductive.

Section 100 forms the lowermost part of the drilling assembly in one embodiment. The drive shaft 112 has a lower drill bit section 114 and an upper mud motor connection section 116. A reduced diameter portion of the hollow shaft 112 connects the sections 114 and 116. The drive shaft 110 has a through bore 118 which forms the passageway for drilling fluid 121 supplied under pressure to the drilling assembly from a surface location. The upper connection section 116 is coupled to the power section of a drilling motor or mud motor (not shown) via a flexible shaft (not shown). A rotor in the drilling motor rotates the flexible shaft, which in turn rotates the drive shaft 110. The lower section 114 houses a drill bit (not shown) and rotates as the drive shaft 110 rotates. A substantially non-rotating sleeve 120 is disposed around the drive shaft 110 between the upper connection section 116 and the drill bit section 114. During drilling, the sleeve 120 may not be completely stationary, but rotate at a very low rotational speed. Typically, the drill shaft rotates between 100 to 600 revolutions per minute (r.p.m.) while the sleeve 120 may rotate at less than 2 r.p.m. Thus, the sleeve 120 is substantially non-rotating with respect to the drive shaft 110 and is, therefore, referred to herein as the substantially non-rotating or non-rotating member or section. The sleeve 120 includes at least one device 130 that requires electric power. In the configuration of FIG. 1, the device 130 operates one or more force application members, such as member 132.

The electric power transfer device 135 includes a transmitter section 142 attached to the outside periphery of the rotating drive shaft 112 and a receiver section 144 attached to the inside of the non-rotating sleeve 120. In the assembled downhole tool, the transmitter section 142 and the receiver section 144 are across from each other with an air gap between the two sections. The outer dimensions of the transmitter section 142 are smaller than the inner dimension of the receiver section 144 so that the sleeve 120 with the receiver section 144 attached thereto can slide over the transmitter section 142. An electronic control circuit 125 (also referred to herein as the "primary electronics") in the rotating member 110 provides the desired electric power to the transmitter 142 and also controls the operation of the transmitter 142. The primary electronics 125 also provides the data and control signals to the transmitter section 142, which transfers the electric power and data to the receiver 144. A secondary electronic control circuit (also referred to herein as the "secondary electronics") is carried by the non-rotating sleeve 120. The secondary electronics 134 receives electric energy from the receiver 144, controls the operation of the electrically-operated device 130 in the non-rotating member 120, receives measurement signals from sensors in the non-rotating section 120, and generates signals which are transferred to the primary electronics via the inductive coupling 135. The transfer of electric power and data between the rotating and non-rotating members are described below with reference to FIGS. 2–4.

Figure 2:
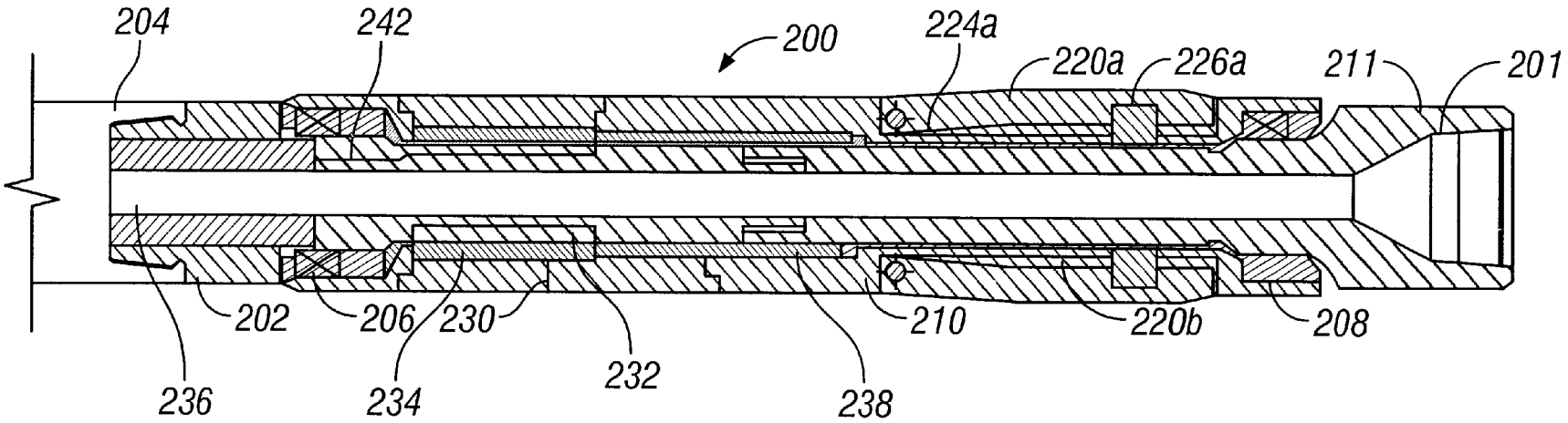
FIG. 2 is a line diagram of a section of a drilling assembly showing the electrical power and data transfer device and the electrical control circuits for transferring power and data between the rotating and non-rotating sections of the drilling. assembly according to one embodiment of the present invention.

FIG. 2 is a line diagram of a bearing assembly 200 section of a drilling assembly which shows, among other things, the relative placement of the various elements shown in FIG. 1. The bearing assembly 200 has a drive shaft 201 which is attached at its upper end 202 to a coupling 204, which in turn is attached to a flexible rod that is rotated by the mud motor in the drilling assembly. A non-rotating sleeve 210 is placed around a section of the drive shaft 211. Bearings 206 and 208 provide radial and axial support to the drive shaft 211 during drilling of the wellbore. The non-rotating sleeve 210 houses a plurality of expandable force application members, such as members 220*a*–220*b* (ribs). The rib 220*a* resides in a cavity 224*a* in the sleeve 210. The cavity 224*a* also includes sealed electro-hydraulic components for radially expanding the rib 220*a*. The electro-hydraulic components may include a motor that drives a pump, which supplies fluid under pressure to a piston 226*a* that moves the rib 220*a* radially outward. These components are described below in more detail in reference to FIGS. 3A–3D.

An inductive coupling device 230 transfers electric power between the rotating and non-rotating members. The device

230 includes a transmitter section 232 carried by the rotating member 110 and a receiver section 234 carried by the non-rotating sleeve 210. The device 230 preferably is an inductive device, in which both the transmitter and receiver include suitable coils. Primary control electronics 236 is preferably placed in the upper coupling section 204. Other sections of the rotating member may also be utilized for housing part or all of the primary electronics 236. Secondary electronics 238 is preferably placed adjacent to the receiver 234. Conductors and communication links 242 placed in the rotating member 201 transfer power and signals between the primary electronics 236 and the transmitter 232. Power in downhole tools such as shown in FIG. 2 is typically generated by a turbine rotated by the drilling fluid supplied under pressure to the drilling assembly. Power may also be supplied from the surface via electrical lines in the tubing or by batteries in the downhole tool.

Figure 3A:
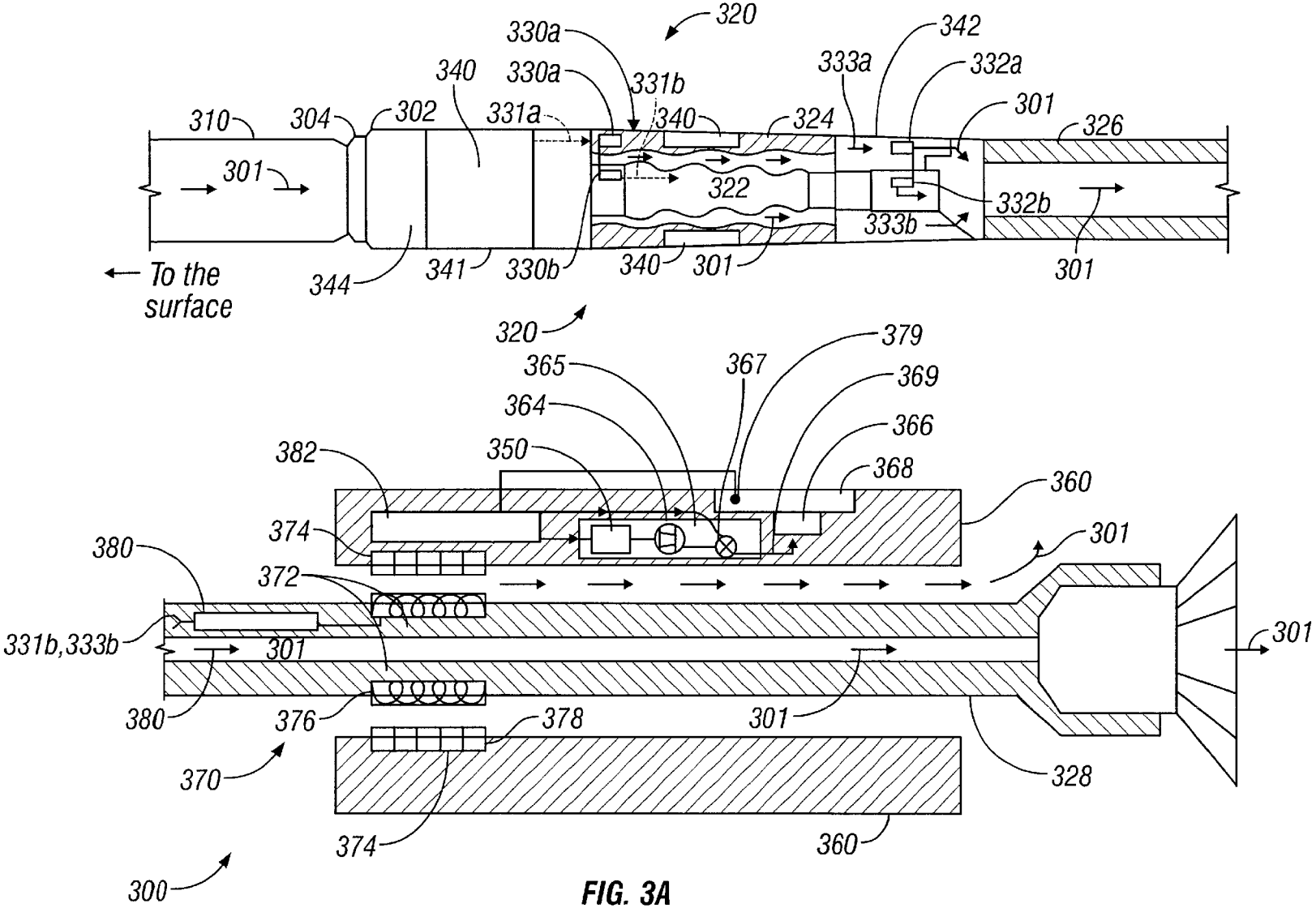
FIGS. 3A–3D are schematic functional diagrams showing several embodiments relating to the power and data transfer device shown in FIGS. 1–2 and for operating devices in a non-rotating section utilizing the power and data transferred from the rotating to the non-rotating sections and for operating devices in a rotating section utilizing power and. data transferred from a non-rotating to the rotating sections.

FIG. 3A is a functional diagram of :a drilling assembly 300 that depicts the method for power and data transfer between the rotating and non-rotating sections of the drilling assembly. Drilling assemblies also referred to as bottom hole assemblies or BHA's used for drilling wellbores and for providing various formation evaluation measurements and measurements-while-drilling measurements are well known in the art and, thus, their detailed layout or functions are not described herein. The description given below is primarily, in the context of transferring electric power and data between a rotating and non-rotating members.

Still referring to the FIG. 3A, the drilling assembly 300 is coupled at its top end or uphole end 302 to a tubing 310 via a coupling device 304. The tubing 310, which is usually a jointed pipe or a coiled tubing, along with the drilling assembly 300 is conveyed from a surface rig into the wellbore being drilled. The drilling assembly 300 includes a mud motor power section 320 that has a rotor 322 inside a stator 324. Drilling fluid 301 supplied under pressure to the tubing 310 passes through the mud motor power section 320, which rotates the rotor 322. The rotor 322 drives a flexible coupling shaft 326, which in turn rotates the drive shaft 328. A variety of measurement-while-drilling ("MWD") and/or logging-while-drilling sensors ("LWD"), generally referenced herein by numeral 340, carried by the drilling assembly 300 provide measurements for various parameters, including borehole parameters, formation evaluation parameters, and drilling assembly health parameters. These sensors may be placed in a separate section or module, such as a section 341, or distributed in one or more sections of the drilling assembly 300. Usually, some of the sensors are placed in the housing 342 of the drilling assembly 300.

Electric power is usually generated by a turbine-driven alternator 344. The turbine is driven by the drilling fluid 301. Electric power also may be supplied from the surface via appropriate conductors or from batteries in the drilling assembly 300. In the exemplary system shown in FIG. 3A, the drive shaft 328 is the rotating member and the sleeve 360 is the non-rotating member. The preferred power and data transfer device 370 between the rotating and non-rotating members is an inductive transformer, which includes a transmitter section 372 carried by the rotating member 328 and a receiver section 374 placed in the non-rotating sleeve 360 across from the transmitter 372. The transmitter 372 and receiver 374 respectively contain coils 376. and 378. Power to the coils 376 is supplied by the primary electrical control circuit 380. The primary electronics 380 generates a suitable A.C. voltage and frequency to be supplied to the coils 376. The A.C. voltage supplied to the coils 376 is preferably at a high frequency e.g. above 500 Hz. The primary electronics also preferably generates a suitable D.C. voltage, which is then used for not-shown circuits on the rotating member 328. The rotation of the drill shaft 328 induces current into the receiver section 374, which delivers A.C. voltage as the output. The secondary control circuit or the secondary electronics 382 in the non-rotating member 360 converts the A.C. voltage from the receiver 372 to the D.C. voltage. D.C. voltage is then utilized to operate various electronic components in the secondary electronics and any electrically-operated devices. Drilling fluid 301 usually fills the gap 311 between the rotating and non-rotating members 328 and 360.

The electric power and the data/signals from a location uphole of the drilling motor power section 320 may be transferred to a location below or downhole of the mud motor power section in a manner similar to as described above in reference to the device 370. In the drilling assembly 300 configuration electric power and data/signals from sections 344 and 340 may be transferred to the rotating members 328 via an inductive coupling device 330*a,* which includes a transmitter section 330*a* that may be placed at a suitable location in the non-rotating section 324 (stator) of the drilling motor 320 and a receiver section 330*b* that may be placed in the rotating section 322 (the rotor). The electric power and data/signals are provided to the transmitter via suitable conductors or links 331*a* while power and data/signals are transferred between the receiver 330*b* and the primary electronics 380 and other devices in the rotating members via communication links 331*b*. Alternatively, the electric power and data/signal transfer device may be located toward the lower end of the power section, such as shown by the location of the device 332. The device 332 includes a transmitter section 332*a* and a receiver section 332*b*. Communication links 333*a* respectively transfers electric power and data/signals between power section 344 and sensor. section 340 on one side and the transmitter 332*a* while communication links 333*b* transfer power and data/signals between receiver 332*b* and devices or circuits, such as circuit 380, in the rotating sections.

Still referring to FIG. 3A and as noted above, a motor 350 operated by the secondary electronics 382 drives a pump 364, which supplies a working fluid, such as oil, from a source 365 to a piston 366. The piston 366 moves its associated rib 368 radially outward from the non-rotating member 360 to exert force on the wellbore. The pump speed is controlled or modulated to control the force applied by the rib on the borehole wall. Alternatively, a fluid flow control valve 367 in the hydraulic line 369 to the piston may be utilized to control the supply of fluid to the piston and thereby the force applied by the rib 368. The secondary electronics 362 controls the operation of the valve 369. A plurality of spaced apart ribs (usually three) are carried by the non-rotating member 360, each rib being independently operated by a common or separate secondary electronics.

The secondary electronics 382 receives signals from sensors 379 carried by the non-rotating member 360. At least one of the sensors 379 provides measurements indicative of the force applied by the rib 368. Each rib has a corresponding sensor. The secondary electronics 382 conditions the sensor signals and may compute values of the corresponding parameters and supplies signals indicative of such parameters to the receiver 372, which transfers such signals to the transmitter 372. A separate transmitter and receiver may be utilized for transferring data between rotating and non-rotating sections. Frequency and/or amplitude modulating techniques and discrete signal transmitting techniques, known in the art, may be utilized to transfer information between the transmitter and receiver or vice versa. The information from the primary electronics may include command signals for controlling the operation of the devices in the non-rotating sleeve.

In the alternative embodiment, the primary electronics and the transmitter are placed in the non-rotating section while the secondary electronics and receiver are located in the rotating section of the downhole tool, thereby transferring electric power from the non-rotating member to the rotating member. These embodiments are described below in more detail with reference to FIG. 4.

Thus, in one aspect of the present invention, electric power and data are transferred between a rotating drill shaft and a non-rotating sleeve of a drilling assembly via an inductive coupling. The transferred power is utilized to operate electrical devices and sensors carried by the non-rotating sleeve. The role of the transmitter and receiver may be reversed.

Figure 3B:
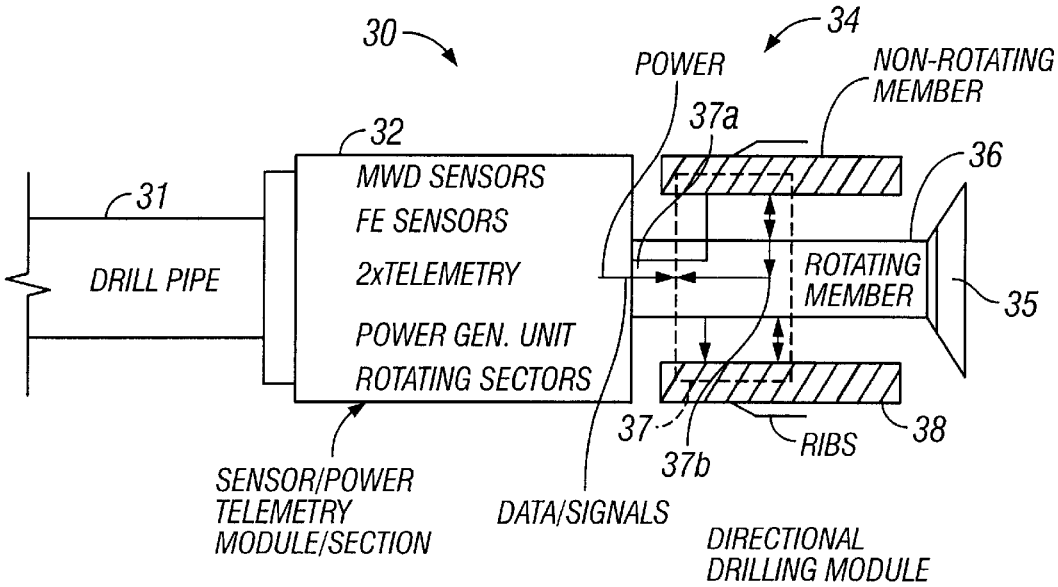

FIG. 3B is a partial functional line diagram of an alternative configuration of a drilling assembly 30 showing the use of the electric power and data/signal transfer device of the present invention. The drilling assembly 30 is shown to include an upper section 32 that may be composed of more than one serially coupled sections or modules. The upper section 32 includes a power section or unit that provides electrical power from a source thereof, MWD/LWD sensors and a two-way telemetry unit. The electric power may be supplied from the surface or generated within the section 32 as described above. The upper section is coupled to a lower section 34 that includes a rotating member 36 which rotates a drill bit 35. A non-rotating member or sleeve 38 is disposed around the rotating member 36.

The drilling assembly 30 is coupled to a drill pipe 31 that is rotated from the surface. The drill pipe 31 rotates the upper section 32 of the drilling assembly 30 and the rotating member 36. The non-rotating member 38 remains substantially stationary with respect to the rotating member 36. Line 37*a* indicates the transfer of electric power from the upper section 32 to the non-rotating section 38 via the transfer device 37 while line 37*b* indicates the two-way communication of data/signals between the rotating member 36 and the non-rotating section 38.

Figure 3C:
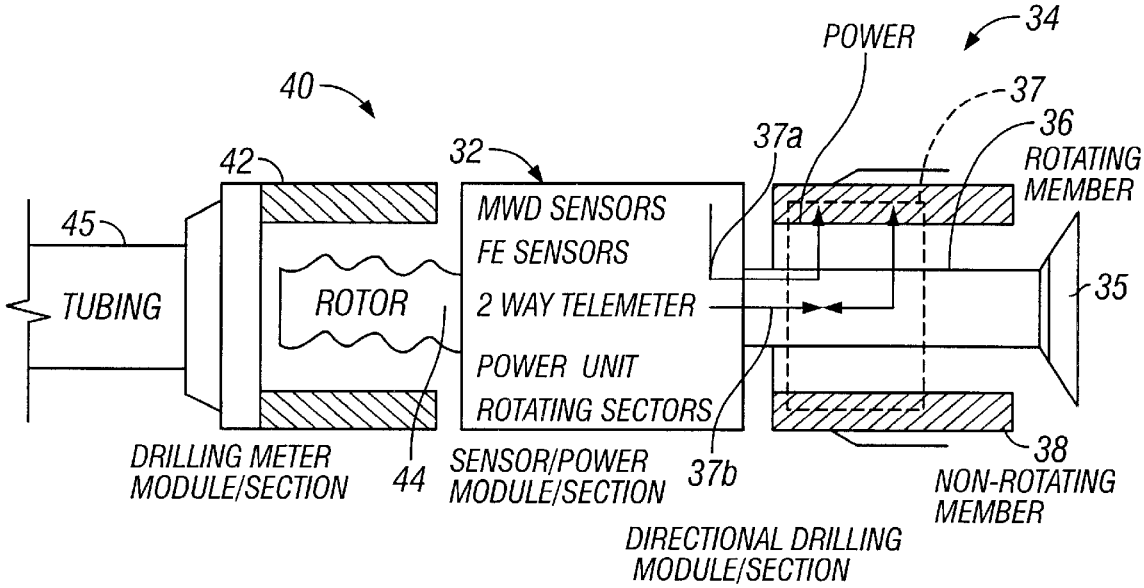

FIG. 3C shows a functional line diagram of yet another configuration of a drilling assembly 40 which includes the section 32 and 34 of FIG. 3B and a drilling motor uphole of the section 32. In this configuration, a rotor 44 of a drilling motor 42 rotates the section 32 and the rotating member 36 attached to the drill bit 35. Tubing 45 may be a drill pipe or a coiled tubing. If drill pipe is used as the tubing. 45, it may be rotated from the surface. The rotation of the drill pipe would be superimposed on the drilling motor rotation to increase the rotation speed of the bit 35. The electric power and data/signals are transferred between the non-rotating section 38 and the rotating section 36 via device 37 as described above in reference to FIG. 3B.

Figure 3D:
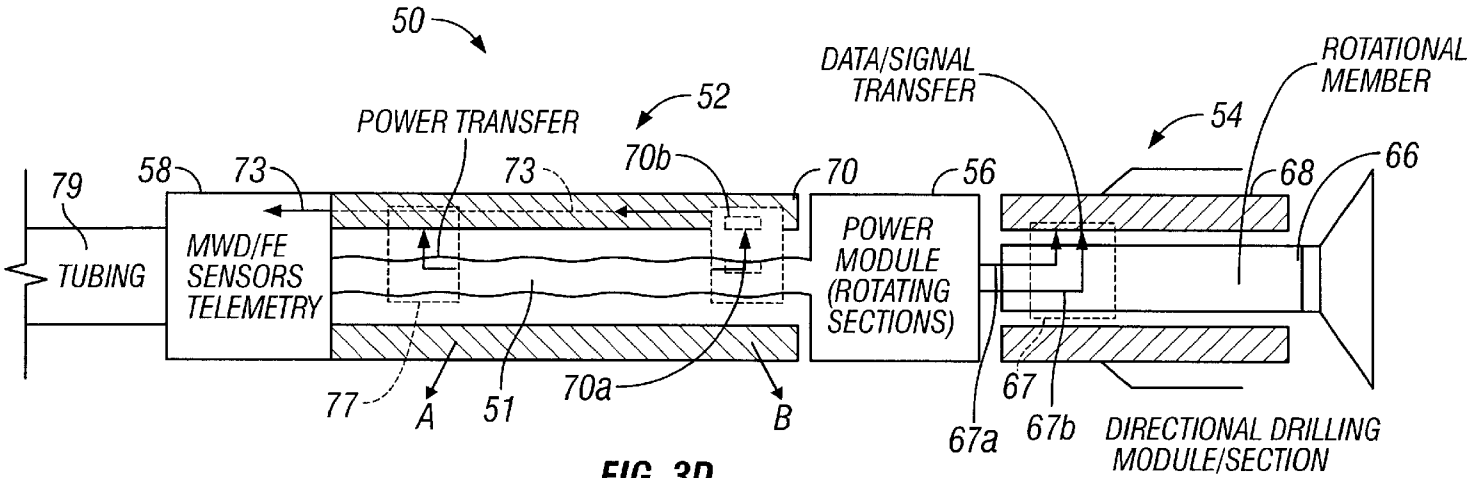

FIG. 3D shows a partial functional line diagram of yet another configuration of a modular drilling assembly 50 utilizing the power and data/signal transfer device of the present invention. The drilling assembly 50 includes a lower section 54, a drilling motor section 52, a power section or module 56 between the drilling motor 52 and the lower section 54 and a sensor/telemetry section 58 uphole of the drilling motor 52. In this configuration, a common electric power module 56 may be used to supply electric power to the lower section 54 and the sensor/telemetry section 58, which is above the mud motor. In this configuration, the drilling motor rotates both the power module 56 and a rotating. member 66. Communication link 67*a* indicate transfer of electric power from the power module 56 to the non-rotating member 68 via an inductive coupling device 67 while links 67*b* indicate two-way data/signal transfer between the rotating member 66 and the non-rotating member 68. Power and data between the power section 56 and the sensor/telemetry section 58 may be transferred via an inductive coupling 70 which includes a transmitter 70*a* in the rotor 51 and a receiver 70*b* in the stationary section 53 (stator section). The power and data transfer between the stator 53 and the sensor telemetry section may be done via communication links 73. The power and data transfer device 70 may be placed at any other suitable location, such as near the upper end, as shown by the dashed-line device 77. A tubing 79 is coupled to the top end of the section 58. A drill pipe or a coiled tubing may be used as the tubing 79. If a drill pipe is used as the tubing 79, it may be rotated from the surface. In such a case, the drill pipe rotation is superimposed on the drilling motor rotation as described above with reference to FIG. 3C.

Figure 4:
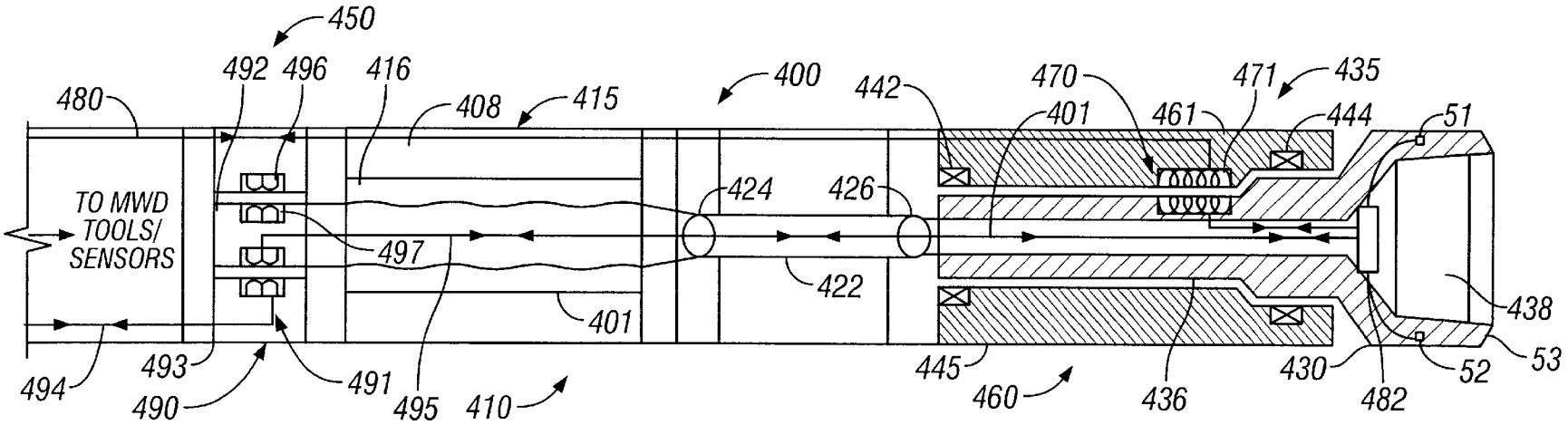
FIG. 4 is a schematic diagram of a portion of a drilling assembly, wherein an inductive coupling is shown disposed in at two alternative locations for transferring power and data between rotating and non-rotating members.

FIG. 4 is a schematic diagram of a portion 400 of an exemplary drilling assembly which show two alternative arrangements for the power and data transfer device. FIG. 4 shows a drilling motor section 415 that includes a rotor 416 disposed in a stator 418. The rotor 416 is coupled to a flexible shaft 422 at a coupling 424. A drill shaft 430 is connected to the lower end 420 of the flexible shaft 422. The drill shaft 430 is disposed in a bearing assembly with a gap 436 therebetween. Drilling fluid 401 supplied under pressure from the surface passes through the power section 410 of the motor 400 and rotates the rotor 416. The rotor rotates the flexible shaft 422, which in turn rotates the drill shaft 430. A drill bit (not shown) housed at the bottom end 438 of the drill shaft 430 rotates as the drill shaft rotates. Bearings 442 and 494 provide radial and axial stability to the drill shaft 430. The upper end 450 of the motor power section 410 is coupled to MWD sensors via suitable connectors. A common or continuous housing 445 may be utilized for the mud motor section 415.

In one embodiment, power and data are transferred between the bearing assembly housing 461 and the rotating drive shaft 430 by an inductive coupling device 470. The transmitter 471 is placed on the stationary housing 461 while the receiver 472 is placed on the rotating drive shaft 430. One or more power and data communication links 480 are run from a suitable location above the mud motor 410 to the transmitter 471. Electric power may be supplied to the power and communication links 480 from a suitable power source in the drilling assembly 400 or from the surface. The communication links 480, may be coupled to a primary control electronics (not shown) and the MWD devices. A variety of sensors, such as pressure sensor $S_1$, temperature sensors $S_2$, vibration sensors $S_3$ etc. are placed in the drill bit.

The secondary control electronics 482 converts the A.C. voltage from the receiver to D.C. voltage and supplies it to the various electronic components in the circuit 482 and to the sensors $S_1$–$S_3$. The control electronics 482 conditions the sensor signals and transmits them to the data transmission section of the device 470, which transmits such signals to the transmitter 371. These signals are then utilized by a primary electronics in the drilling assembly 400. Thus, in the embodiment described above, an inductive coupling device transfers electric power from a non-rotating section of the bearing assembly to a rotating member. The inductive coupling device also transfers signals between these rotating and non-rotating members. The electric power transferred to the rotating member is utilized to operate sensors and devices in the rotating member. The inductive devices also establishes a two-way data communication link between the rotating and non-rotating members.

In an alternative embodiment, a separate subassembly or module 490 containing an inductive device 491 may be disposed above or uphole of the mud motor 415. The module 490 includes a member 492, rotatably disposed in a non-rotating housing 493. The member 492 is rotated by the mud motor 410. The transmitter 496 is disposed on the non-rotating housing 493 while the receiver 497 is attached to the rotating member 492. Power and signals are provided to the transmitter 496 via conductors 494 while the received power is transferred to the rotating sections via conductors 495. The conductors 495 may be run through the rotor, flexible shaft and the drill shaft. The power supplied to the rotating sections may be utilized to operate any device or sensor in the rotating sections as described above. Thus, in this embodiment, electric power is transferred to the rotating members of the drilling assembly by a separate module or unit above the mud motor.

Figure 5A:
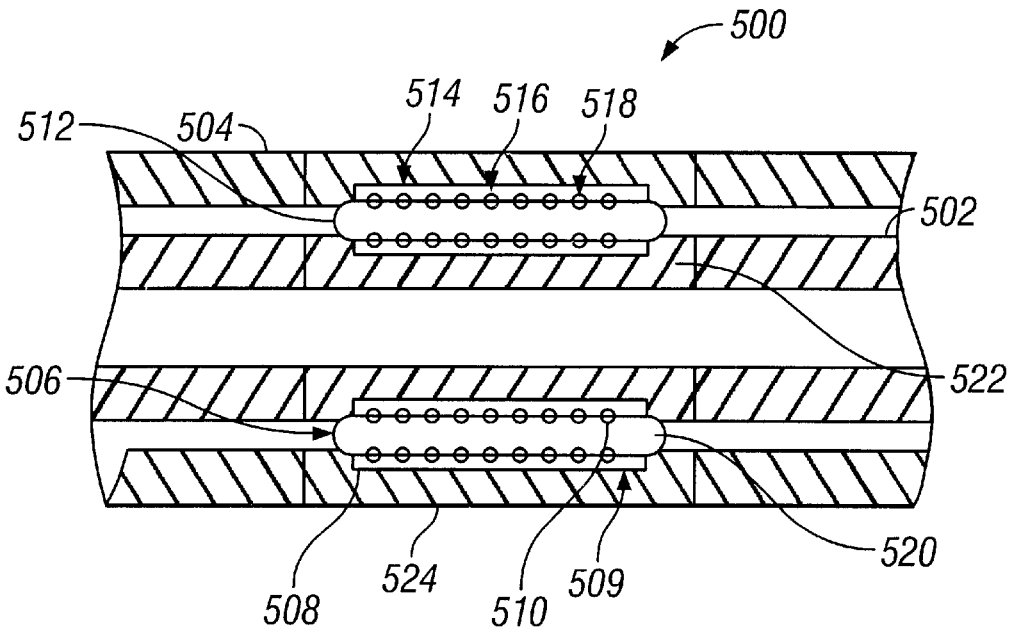
FIGS. 5A–5B are cross-section diagrams of two possible configurations for the inductive coupling of a tool according to the present invention.
Figure 5B:
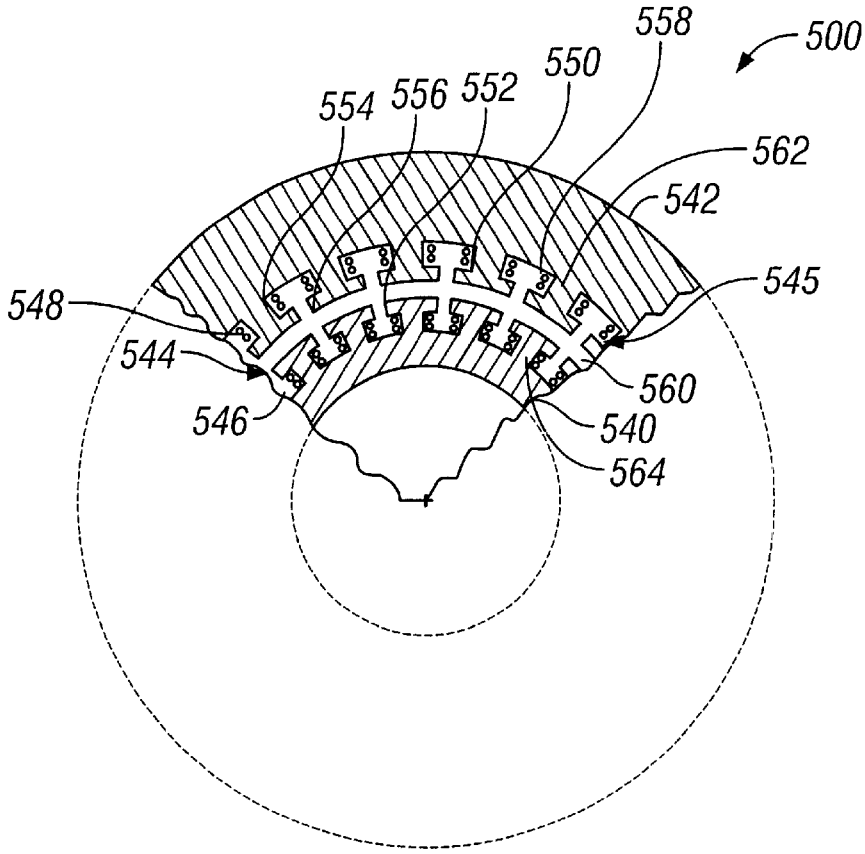

FIGS. 5A–5B are cross-section diagrams of two possible configurations of an inductive coupling for use in embodiments of the present invention such as those described above and shown in FIGS. 1–4. In FIG. 5A, a portion 500 of a drilling assembly according to the present invention includes a rotating member 502 and a non-rotating member 504. Elements of the invention not shown in FIG. 5A are substantially identical to elements described above and shown in FIGS. 1–4.

A rotating member 502 is coupled to the drilling assembly 500. A transmitter 506 is coupled to the rotating member 502. The transmitter 506 includes transmitter windings 510 of insulated wires. The transmitter 506 includes at least a portion 522 comprising a soft ferro-magnetic material such as soft iron or Ferrite used to concentrate a magnetic field to be described later.

A non-rotating member 504 is coaxially disposed about the rotating member 502. A receiver 509 is coupled to the non-rotating member 504. The receiver 509 includes receiver windings 508 of insulated wires. The receiver 509 includes at least a portion 524 comprising a soft ferro-magnetic material such as soft iron or Ferrite used to concentrate a magnetic field through the receiver windings 508.

The transmitter windings 510 and receiver windings 508 are separated from each other by a gap 520. The gap 520 may be filled or evacuated. If filled, the gap may be filled with a fluid of gas or liquid, and the fluid may be either conducting or non-conducting.

Electrical current provided by an electronic control circuit (see ref. 125 of FIG. 1) flows through the transmitter windings 510, to generate an electromagnetic field 512. The field 512 traverses the gap 520 and encompasses the receiver windings 508. A current is generated in the receiver windings 508 whenever the field 512 is a changing field. The field 512 is effectively a changing field if the current in the transmitter windings 510 is an AC current.

The current induced in the receiver windings 508 may be used to provide power, data or both to various electrical components carried by the non-rotating member 504. Specific electrical components are not shown in FIG. 5A, although examples of electrical components are described above and shown in FIGS. 1–4. One or more points 514, 516 and 518 on the receiver windings 508 are used for connecting circuits to the receiver 509. Those versed in the art will recognize that a particular point 514 selected on the receiver winding 508 will establish a particular voltage referenced to a predetermined ground (or neutral) point which is another point 518 along the receiver winding 508.

In an alternative embodiment (not shown), the receiver 509 comprises a plurality of receiver winding sections electrically and physically separated from each other. Each receiver winding may be used to receive power and/or data signals from the transmitter 506. Each receiver winding may then conduct the power and/or data signals to an independent electrical component in the non-rotating sleeve 504.

FIG. 5B shows a partial cross-section of a drilling assembly 500 according to the present invention with an alternative configuration of an inductive coupling. Elements of the invention not shown in FIG. 5B are substantially identical to elements described above and shown in FIGS. 1–4.

The configuration shown in FIG. 5B includes a transmitter 544 coupled to a rotating member 540 of the drilling assembly 500. A plurality of transmitter elements (shoes) 552 are coupled to the transmitter such that the shoes 552 rotate with the rotating member 540. Each transmitter shoe 552 comprises a transmitter winding 546 that rotates with the rotating member 540. The transmitter 544 includes at least a portion 564 comprising a soft ferro-magnetic material such as soft iron or Ferrite used to concentrate a magnetic field through the transmitter windings 546. In a preferred embodiment, each transmitter shoe structure is included in the portion 564.

A substantially non-rotating member 542 is disposed about the rotating member 540. A receiver 545 is coupled to the non-rotating member 542. A plurality of receiver elements (shoes) 550 are coupled to the receiver 545, and each receiver shoe 550 includes a receiver winding 548. The receiver 545 includes at least a portion 562 comprising a soft ferro-magnetic. material such as Soft iron or Ferrite used to concentrate a magnetic field through the receiver windings 548. In a preferred embodiment, each shoe structure is included in the portion 562.

A gap 560 separates the receiver 545 from the transmitter 544. The gap 560 may be filled or evacuated. If filled, the gap may be filled with a fluid of gas or liquid either conducting or non-conducting. The gap 560 is preferably filled with a substantially non-conducting fluid.

As described above and shown in FIG. 5A, a plurality of not-shown electrical components may be operated using power and data signals taken from the receiver 545. A different. component may be connected to the receiver 545 at any of a number of points 554, 556 and 558. Each connection point is preferably a winding 548 of a particular receiver shoe 550.

The foregoing description. is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all, such modifications and changes.

What is claimed is:

1. A drilling assembly for use in drilling of a wellbore, comprising:

(a) a rotating member;

(b) a non-rotating sleeve placed around the rotating member with a gap there between; and (c) an inductive coupling device associated with the rotating member and the non-rotating sleeve for transferring electric power to the rotating member from the non-rotating sleeve.

2. The drilling assembly according to claim 1, wherein the inductive coupling device includes a transmitter and a receiver.

3. The drilling assembly according to claim 1, wherein the gap is filled by a fluid.

4. The drilling assembly according to claim 3, wherein said fluid is selected from a group consisting of (i) drilling fluid, (ii) oil sealed between said rotating member and said non-rotating sleeve, (iii) a conductive fluid, and (iv) a non-conductive fluid.

5. The drilling assembly according to claim 2, wherein the transmitter is carried by the rotating member and the receiver is carried by the non-rotating sleeve.

6. The drilling assembly according to claim 1 further comprising an electrically-operated device on the non-rotating sleeve for performing an operation downhole.

7. The drilling assembly according to claim 6 further comprising a control circuit carried by the non-rotating sleeve for transferring electric power to said electrically-operated device.

8. The drilling assembly according to claim 6, wherein the electrically operated device is one of (i) electrically-operated pump; (ii) a control valve; and (iii) a downhole sensor.

9. The drilling assembly according to claim 1, wherein the inductive coupling device transfers information between the rotating member and the non-rotating sleeve.

10. The drilling assembly according to claim 9, wherein the information is transferred by one of (i) frequency modulation, (ii) amplitude modulation, and (iii) discrete signals.

11. The drilling assembly according to claim 6 further comprising a control circuit associated with the non-rotating sleeve for controlling the operation of said electrically-operated device.

12. The drilling assembly according to claim 1, wherein said rotating member is a drill shaft rotatably disposed in the non-rotating sleeve.

13. The drilling assembly according to claim 1, wherein the inductive coupling device is disposed uphole of a mud motor in the drilling assembly and the electric power is transferred from the non-rotating sleeve to the rotating member.

14. The drilling assembly according to claim 13, wherein the rotating member is rotated by the mud motor.

15. The drilling assembly according to claim 13, wherein said mud motor is operatively coupled to a drill bit to rotate said drill bit during drilling of the wellbore and wherein said drill bit includes at least one (1) electrically-operated device that utilizes electric power transferred to said rotating member.

16. The drilling assembly according claim 13 further comprising an electrical control circuit.

17. The drilling assembly according to claim 2, wherein said transmitter is disposed in the non-rotating sleeve and the receiver is carried by the rotating member.

18. The drilling assembly according to claim 17, wherein the rotating member is a drill shaft adapted to be coupled to a drill bit.

19. The drilling assembly according to claim 17 further comprising at least one (1) sensor associated with a drill bit, said sensor receiving electric power from said receiver.

20. A drilling assembly for drilling a wellbore comprising:

(a) a mud motor having (i) a power section containing a rotor disposed in a stator, said rotor rotating in said stator upon the passage of fluid under pressure through the mud motor; and (ii) a bearing assembly having a drive shaft disposed in a non-rotating housing with a gap therebetween, said driveshaft operatively coupled to and rotated by said rotor, and said drive shaft adapted to accommodate a drill bit at an end thereof;

(b) an inductive coupling device in said bearing assembly for transferring electric power from said non-rotating housing to said rotating drive shaft during drilling of the wellbore.

21. The drilling assembly according to claim 20, wherein said inductive coupling device receives electric power from a source uphole of said mud motor.

22. The drilling assembly according to claim 20 further comprising at least one (1) sensor associated with said rotating drill shaft, said sensor receiving electric power transferred to said rotating drill shaft.

23. The drilling assembly according to claim 20, wherein said inductive coupling device includes a transmitter in said housing and a receiver carried by said drill shaft.

* * * * *